US010022880B2

(12) United States Patent
McFarland

(10) Patent No.: US 10,022,880 B2
(45) Date of Patent: Jul. 17, 2018

(54) DISPOSABLE PLASTIC KNIVES WITH SERRATED CUTTING EDGE

(71) Applicant: David B. McFarland, Rainbow City, AL (US)

(72) Inventor: David B. McFarland, Rainbow City, AL (US)

(73) Assignee: Gadsden Coffee Company, Inc., Attalla, AL (US)

( * ) Notice: Subject to any disclaimer, the term of this patent is extended or adjusted under 35 U.S.C. 154(b) by 4 days.

(21) Appl. No.: 14/171,763

(22) Filed: Feb. 3, 2014

(65) Prior Publication Data

US 2014/0157607 A1 Jun. 12, 2014

Related U.S. Application Data

(60) Provisional application No. 61/732,844, filed on Dec. 3, 2012.

(51) Int. Cl.
*B26B 9/02* (2006.01)
*B26B 9/00* (2006.01)

(52) U.S. Cl.
CPC . *B26B 9/02* (2013.01); *B26B 9/00* (2013.01)

(58) Field of Classification Search
CPC .... B26B 9/00; B26B 9/02; B26B 3/00; B26B 13/08; B26B 3/02; B26D 61/12; B26D 61/121; B26D 61/126; B23D 49/11
USPC ..... 30/355, 142, 147, 148, 149, 353, 357
See application file for complete search history.

(56) References Cited

U.S. PATENT DOCUMENTS 229,772 A * 7/1880 Suisse ..... B23D 61/121 83/852
700,617 A * 5/1902 Cabaugh ..... A47J 17/04 30/123.7
2,555,735 A * 6/1951 Estabrooks ..... B26B 9/02 30/355
2,750,669 A * 6/1956 Hohmann ..... B26B 9/00 30/355
2,757,697 A * 8/1956 Simmons ..... B26D 1/0006 30/355

(Continued)

FOREIGN PATENT DOCUMENTS

CH 523750 A * 6/1972 ..... B26B 9/02
DE 1052860 B * 3/1959 ..... B26B 9/02

(Continued)

*Primary Examiner* — Jennifer Swinney
(74) *Attorney, Agent, or Firm* — Loza & Loza, LLP; Julio Loza

(57) ABSTRACT

A plastic knife is provided comprising a handle, a blade, and a cutting edge. The blade may include a first surface and an opposite second surface, and integrally formed with and extending longitudinally from the handle. The cutting edge may be formed along one edge of the blade, the cutting edge comprising: (a) a first plurality of teeth integrally connected to and extending from the first surface, each tooth in the first plurality of teeth separated by a first concave groove; and (b) a second plurality of teeth integrally connected to and extending from the second surface, each tooth in the second plurality of teeth separated by a second concave groove. The first plurality of teeth and the second plurality of teeth may be integrally formed together while teeth in the first plurality of teeth and teeth in the second plurality of teeth are offset by a distance.

15 Claims, 7 Drawing Sheets

(56) References Cited

U.S. PATENT DOCUMENTS

| | | | | | |
|---|---|---|---|---|---|
| 2,825,968 | A * | 3/1958 | Baer | B26B 9/02 | 30/355 |
| 4,907,344 | A * | 3/1990 | Hahn | B26B 9/02 | 30/355 |
| 5,054,177 | A * | 10/1991 | Jensen | B23D 71/005 | 407/29.12 |
| 5,572,794 | A * | 11/1996 | Kalbern | B26B 9/02 | 30/353 |
| 5,946,985 | A * | 9/1999 | Carlsen | B23D 61/021 | 76/112 |
| 6,044,566 | A * | 4/2000 | Ries | B26B 9/02 | 30/345 |
| 2001/0039738 | A1* | 11/2001 | Bachta | B23D 49/11 | 30/517 |
| 2009/0144992 | A1* | 6/2009 | Bucks | B23D 61/128 | 30/355 |

FOREIGN PATENT DOCUMENTS

| | | | | |
|---|---|---|---|---|
| DE | 1078011 B | * | 3/1960 | B26B 9/02 |
| GB | 695366 A | * | 8/1953 | B26B 9/02 |
| GB | 886832 A | * | 1/1962 | B26B 9/02 |

* cited by examiner

DISPOSABLE PLASTIC KNIVES WITH SERRATED CUTTING EDGE

CLAIM OF PRIORITY UNDER 35 U.S.C. § 119

The present Application for Patent claims priority to U.S. Provisional Application No. 61/732,844 entitled "Disposable Plastic Knives", filed Dec. 3, 2012, which is hereby expressly incorporated by reference herein.

FIELD

Various embodiments of the invention pertain to plastic or disposable cutlery, and more particularly, to disposable plastic knives having a serrated edged.

BACKGROUND

Plastic knives are widely used around the world for disposable use. Such disposable use include the use outdoors, such as for camping and barbeques, at fast-food restaurants and on airplanes. In addition to the benefits of being disposable, plastic knives may be preferable for use over metal knives or other cutlery for weight and safety reasons.

However, despite the widespread use of disposable plastic knives, there are many problems inherent with conventional disposable plastic knives. First, conventional disposable plastic knives are not designed to cut (tear) food equally well when the knife is stroked forward or backward. Second, conventional disposable plastic knives fail to have stacking edges that mate properly regardless of the shape of the profile of the knives.

In view of the above, what is needed are disposable plastic knives designed to cut (tear) food equally well when the knife is stroked forward or backward. Furthermore, disposable plastic knives are needed that have stacking edges that mate properly regardless of the shape of the profile of the knives allowing for optimization of the handle of the knives by making it strong and lighter in weight.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to a first example, a plastic knife is provided comprising a handle, a blade, and a cutting edge. The blade may include a first surface and an opposite second surface, and integrally formed with and extending longitudinally from the handle. The cutting edge may be formed along one edge of the blade, the cutting edge comprising: (a) a first plurality of teeth integrally connected to and extending from the first surface, each tooth in the first plurality of teeth separated by a first concave groove; and (b) a second plurality of teeth integrally connected to and extending from the second surface, each tooth in the second plurality of teeth separated by a second concave groove. The first plurality of teeth and the second plurality of teeth may be integrally formed together while teeth in the first plurality of teeth and teeth in the second plurality of teeth are offset by a distance.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION

In the following description numerous specific details are set forth in order to provide a thorough understanding of the invention. However, one skilled in the art would recognize that the invention might be practiced without these specific details. In other instances, well known methods, procedures, and/or components have not been described in detail so as not to unnecessarily obscure aspects of the invention.

Overview

A first feature provides a disposable plastic knife having a serrated edge. The serrated edge may include a first row of teeth on a first side of a knife blade and a second row of teeth on an opposite second side of the knife blade, where the teeth in the first row and second row are offset from each other.

A second feature provides a disposable plastic knife having a serrated edge with different sized teeth on each side of a blade. The serrated edge may include a first row of teeth on a first side of a knife blade and a second row of teeth on an opposite second side of the knife blade. The teeth in the first row may be of a first width while the teeth on the second side of the blade may be of a second width.

Plastic Knife with Serrated Cutting Teeth

Figure 1:
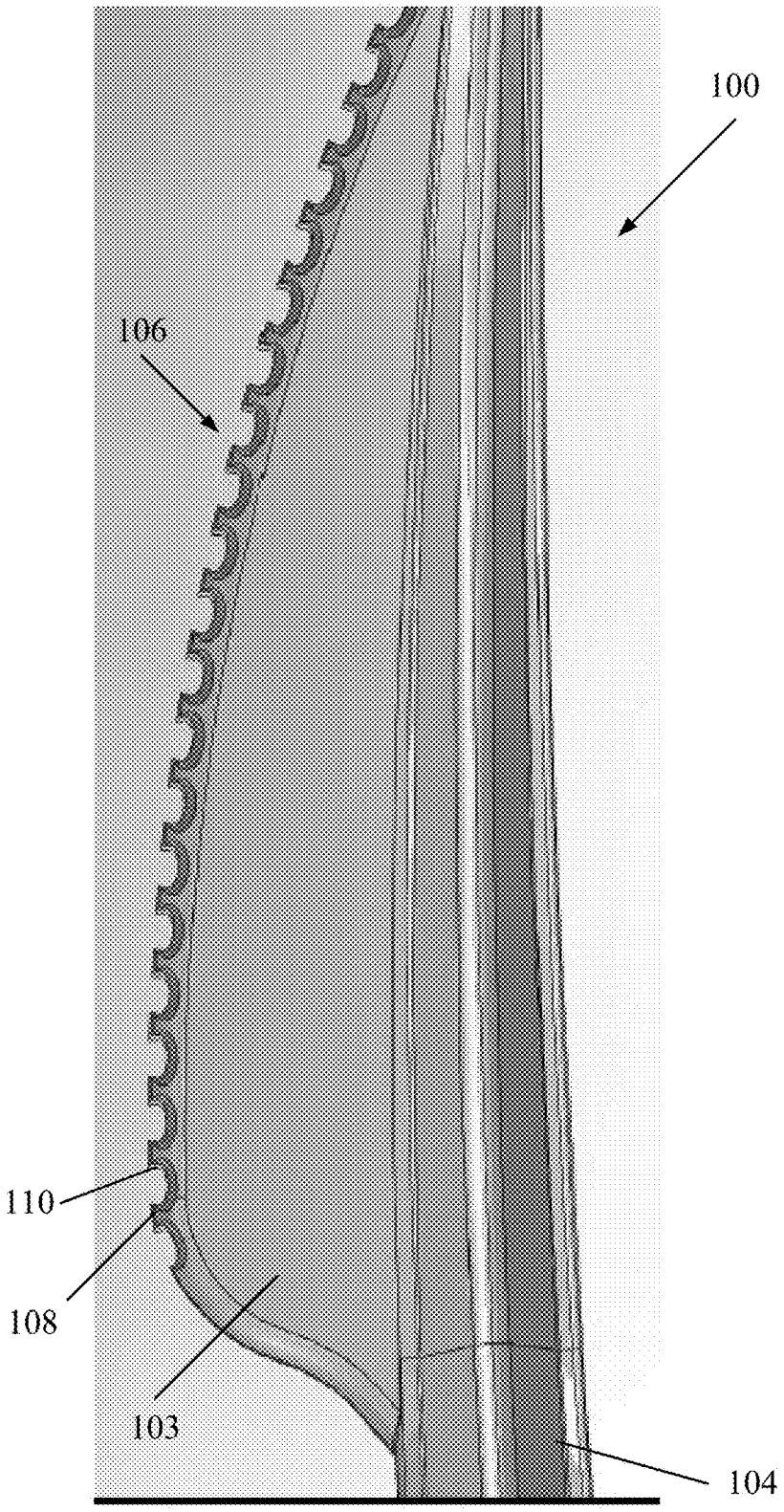
FIG. 1 illustrates a partial side plan view of a plastic knife, according to one example.

FIG. 1 illustrates a partial side plan view of a plastic knife 100 according to one example. In one example, the plastic knife 100 may be made from a polystyrene material.

Figure 2:
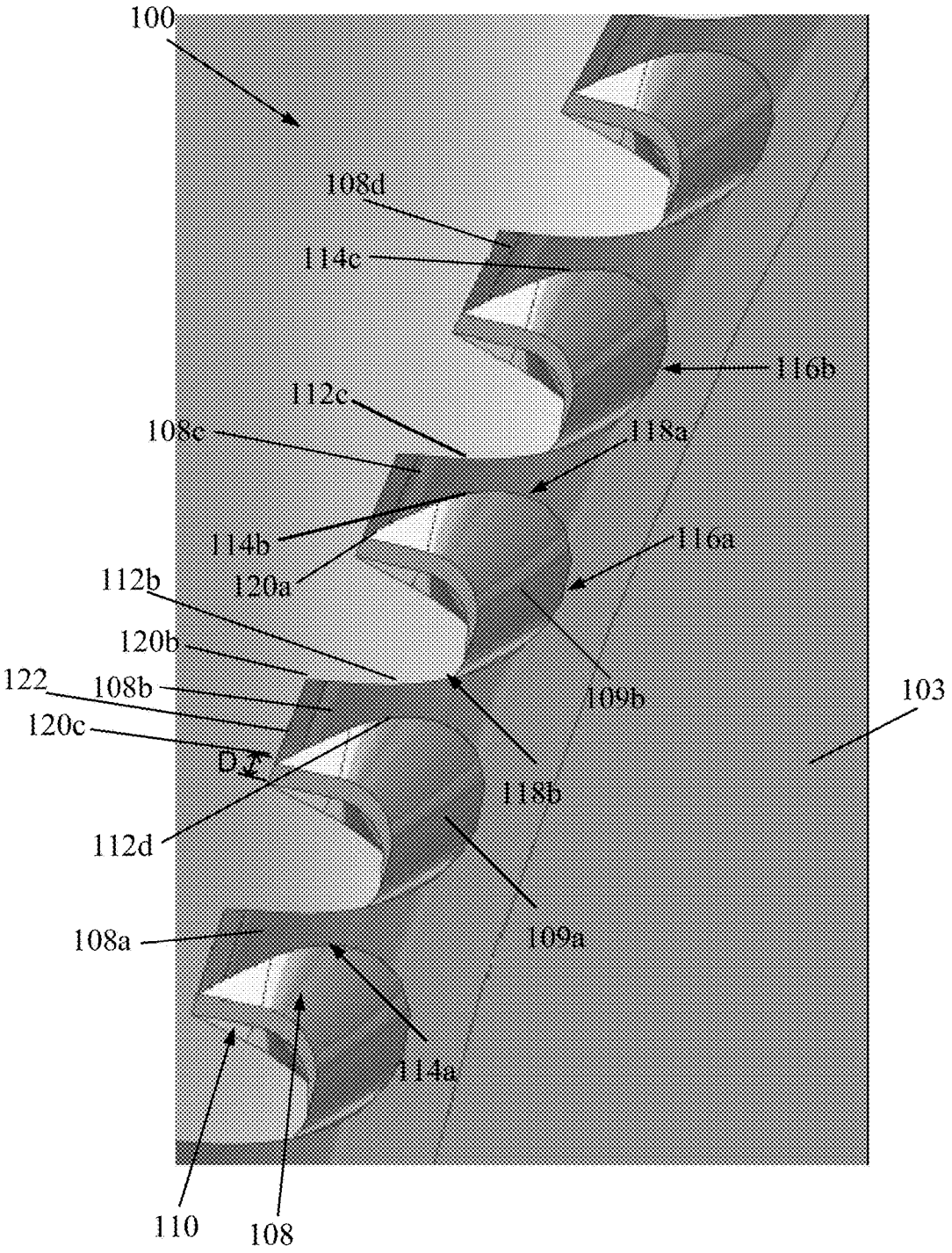
FIG. 2 illustrates a close up angular view of the serrated teeth of the knife of FIG. 1.

FIG. 2 illustrates a close up angular view of the serrated teeth of the knife 100 of FIG. 1.

Figure 3:
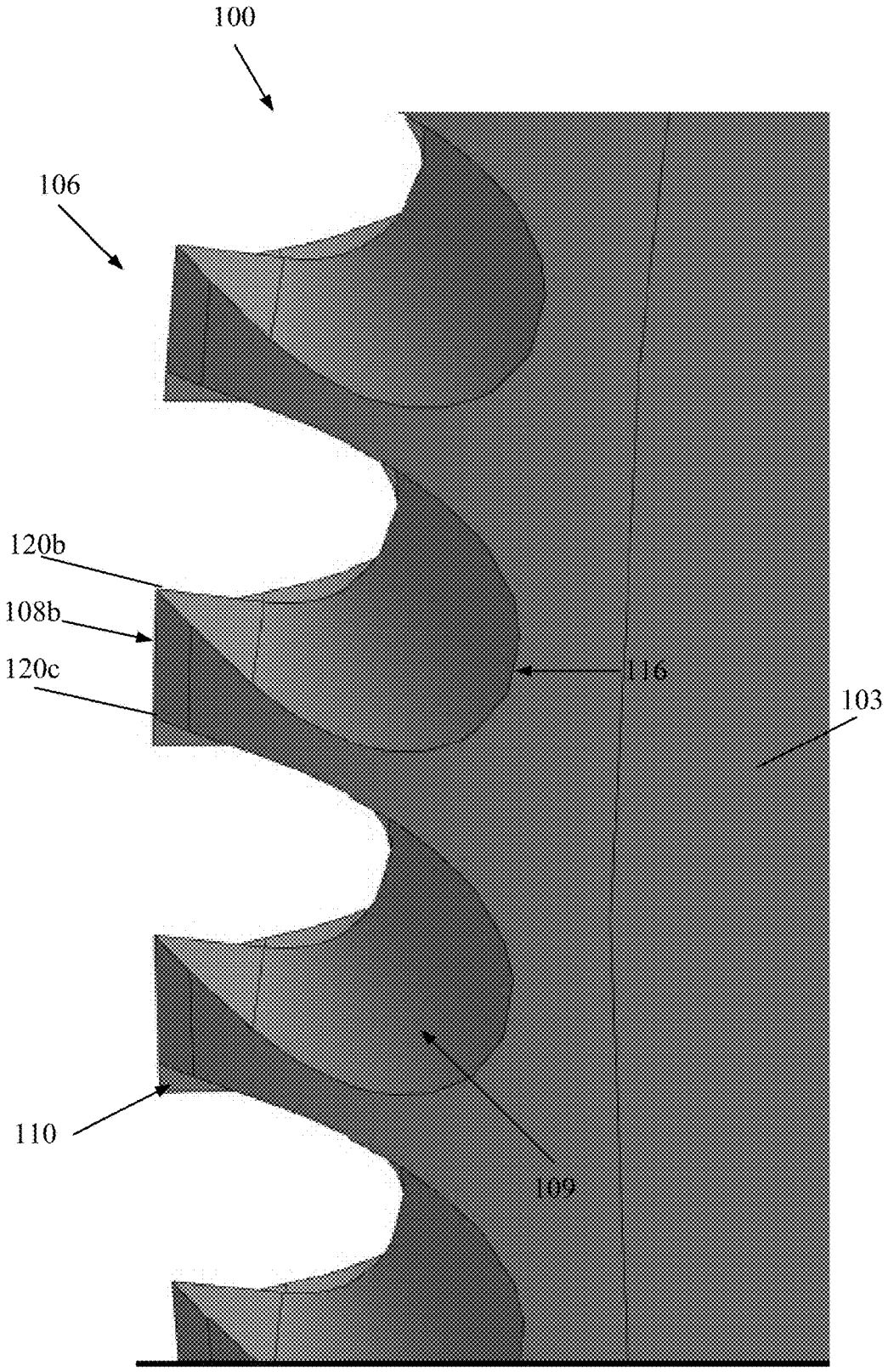
FIG. 3 illustrates a close up view of the serrated teeth of the knife of FIG. 1.

FIG. 3 illustrates a close up view of the serrated teeth of the knife 100 of FIG. 1.

Figure 4:
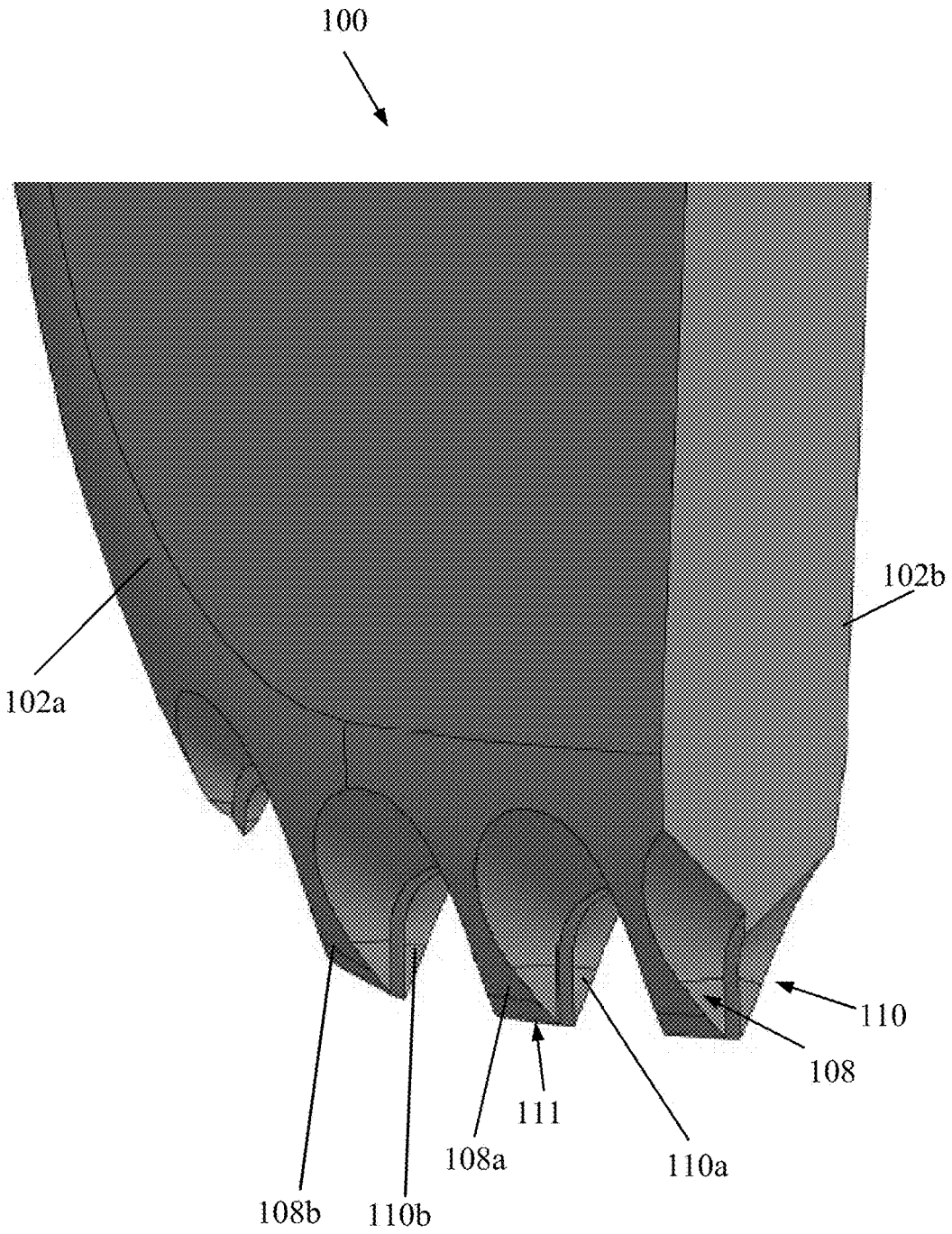
FIG. 4 illustrates a cross sectional view of the serrated teeth of the knife of FIG. 2.

FIG. 4 illustrates a cross sectional view of the serrated teeth of the knife 100 of FIG. 2.

The plastic knife 100 (FIGS. 1-4) may be molded from a plastic material and include a blade 103, having a first surface 102*a* and a second surface 102*b*, integrally formed with a handle 104. The blade 103 may extend longitudinally from the handle 104 and include a cutting edge 106 extending downwardly from the blade 103. The cutting edge 106 may comprise a first plurality of teeth 108 integrally connected to and extending downwardly from the first surface 102*a* of the blade 103 and a second plurality of teeth 110 integrally connected to and extending downwardly from the second surface 102*b* of the blade 103.

Each tooth in the first plurality of teeth 108 (108*a*, 108*b*, 108*c*, 108*d*) may be separated by a concave groove 109 (109*a*, 109*b*) and comprise a first side 112 and a second side 114 having arcuate or curved shapes. As shown, the first side 112 and the second side 114 may be a mirror image of each other and integrally connected to adjacent concave grooves 109. That is, a first side 112*c* of one tooth 108*c* may be integrally connected to a concave groove and a second side 114*b* of the tooth is connected to a different, adjacent concave groove. Such concave grooves 109 may be defined between adjacent teeth 108. Additionally, as illustrated in FIG. 4, each composite knife tooth 111 may comprise a first tooth segment 108*a* (on the first surface/side 102*a* of the blade 103) and a second tooth segment 110*a* (on the second surface/side 102*b* of the blade 103).

As shown, for example, the second side 114*b* of a first tooth 108*c* may be formed together with the first side 112*b* of a second tooth 108*b* at a first or top point 116*a* of a first concave groove 109*b*. From the first or top point 116*a*, the second side 114*b* of the first tooth 108*c* extends outwardly to a second or middle point 118*a* and then extends inwardly to a third or end point 120*a*. Similarly, from the first or top point 116*a*, the first side 112*b* of the second tooth 108*b* extends outwardly to a fourth or middle point 118*b* and then extends inwardly to a fifth or end point 120*b*. In this manner, the first concave groove 109*b* is defined. In one example, the concave groove 109*b* may be a scalloped cut design.

A cutting portion 122 of the tooth 108*b* may extend between a first end point 120*b* of the second side 112*b* of the first tooth 108*b* and a second end point 120*c* of the second side 112*d* of the first tooth 108*b*.

Similarly, although not shown in detail, each tooth in the second plurality of teeth 110 may be a mirror image of each tooth in the first plurality of teeth 108, separated by a concave groove and comprise a first side and a second side having arcuate or curved shapes. The first side and the second side may be a mirror image of each other and integrally connected to adjacent concave grooves. That is, the first side of one tooth is integrally connected to a concave groove and the second side of the tooth is connected to a different, adjacent concave groove.

Although the teeth in the first plurality of teeth 108 may be a mirror image of the teeth in the second plurality of teeth 110 and integrally formed together, the teeth in the first plurality of teeth 108 and the teeth in the second plurality of teeth 110 may be offset by a distance D. For instance, the distance D may be 0.25 mm. Offsetting the teeth between the two different surfaces 102*a* and 102*b* may form a sharp point with a complex cutting edge that runs approximately vertical and by design has the ability to cut (tear) food equally well when the knife is stroked forward or backward. Although such an offset would be difficult if not extremely expensive to accomplish in steel, as it would require tiny cutting tools on a computer numerical control (CNC) machine and would take a long time to do on an expensive piece of machinery, creating such an offset may be easily and cost effectively molded in plastic. Additionally, the cutting teeth may have negative rake which is good for use in plastic because plastic knives cannot really cut like a steel knife (e.g., due to lack of hardness) they can only tear through the food.

Plastic Knife with Serrated Cutting Teeth of Different Widths

Figure 5:
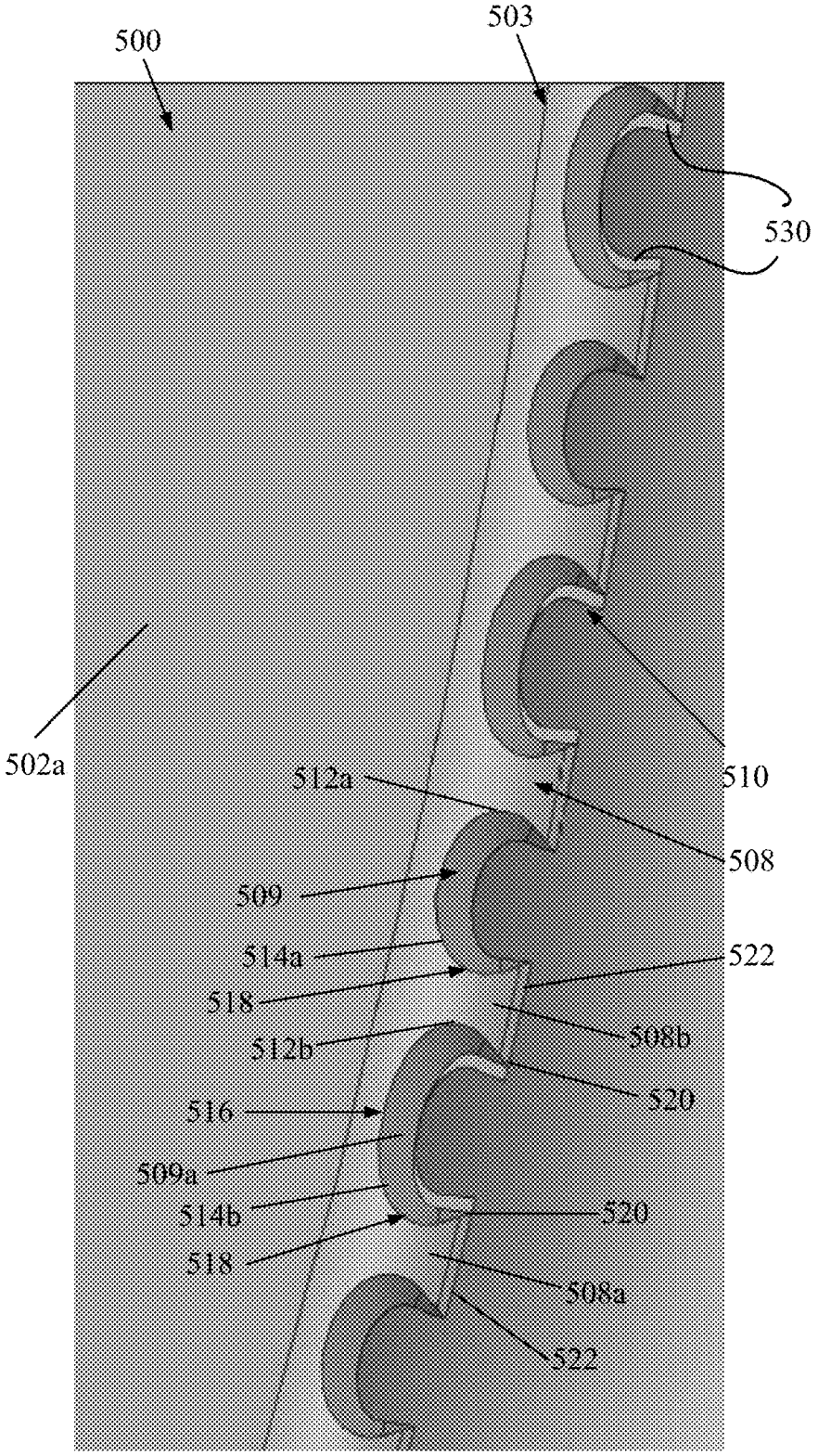
FIG. 5 illustrates a close up angular view of serrated teeth of a plastic knife, according to one example.

FIG. 5 illustrates a close up angular view of serrated teeth of a plastic knife, according to one example.

Figure 6:
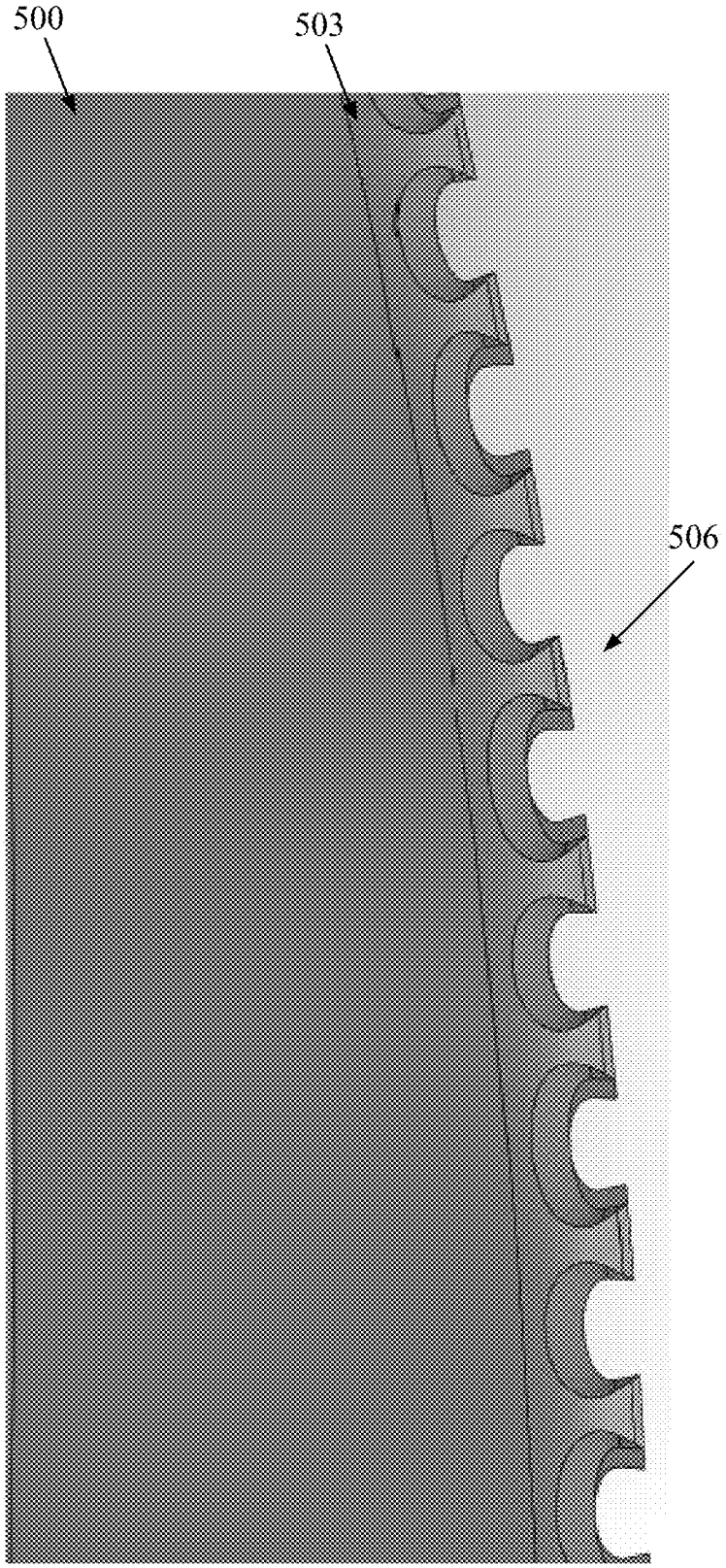
FIG. 6 illustrates a close up view of serrated teeth of the plastic knife of FIG. 5.

FIG. 6 illustrates a close up view of serrated teeth of the plastic knife of FIG. 5.

The plastic knife 500 may be molded from a plastic material and include a blade 503, having a first surface 502*a* and an opposite second surface (not shown), integrally formed with a handle. The blade 503 may extend longitudinally from the handle and include a cutting edge 506 extending downwardly from the blade 503. The cutting edge 506 may comprise a first plurality of teeth 508 integrally connected to and extending downwardly from the first surface 502*a* of the blade 503 and a second plurality of teeth 510 integrally connected to and extending downwardly from the second surface of the blade 503.

Each tooth in the first plurality of teeth 508 may be separated by a concave groove 509 and comprise a first side 512 and a second side 514 having an arcuate or curved shape. As shown, the first side 512 and the second side 514 may be a mirror image of each other and integrally connected to adjacent concave grooves 509. That is, the first side of one tooth is integrally connected to a concave groove and the second side of the tooth is connected to a different, adjacent concave groove.

As shown, for example, the second side 514*b* of a first tooth 508*a* is formed together with the first side 512*b* of a second tooth 508*b* at a first or top point 516 of a first concave groove 509*a*. From the first or top point 516, both the second side 514*b* of the first tooth 508*a* and the first side 512*b* of the second tooth 508*b* extend outwardly to a second or middle point 518 and then extend inwardly to a third or end point 520 forming a convex shape and the first concave groove 509*a*. A cutting portion 522 may extend between the end points 520 of the second side 514*b* of the first tooth 508*a* and the first side 512*b* of the second tooth 508*b*.

Similarly, although not shown in detail, each tooth in the second plurality of teeth 510 may have the same shape of each tooth in the first plurality of teeth 508, separated by a concave groove and comprise a first side and a second side having an arcuate or curved shape. The first side and the second side may be a mirror image of each other and integrally connected to adjacent concave grooves. That is, the first side of one tooth is integrally connected to a concave groove and the second side of the tooth is connected to a different, adjacent concave groove.

Although the teeth in the first plurality of teeth 508 may be the same shape of the teeth in the second plurality of teeth 510 and integrally formed together, the teeth in the first plurality of teeth 508 and the teeth in the second plurality of teeth 510 may be of different sizes. That is, the teeth in the first plurality of teeth 508 may have first width and the teeth in the second plurality of teeth 510 may have a second width, where the first width is different than the second width. According to one embodiment, the first width may be greater than the second width. Alternatively, the second width may be greater than the first width.

As shown in FIG. 5, the second width is greater than the first width such that the teeth in the first plurality of teeth 508 are smaller than the teeth in the second plurality of teeth 510. When the first plurality of teeth 508 and the second plurality of teeth 510 are integrally connected, a pair of offsets 530 are located within a shared concave groove, wherein the shared concave groove includes a first tooth side and a second tooth side. Additionally, the offsets 530 alternate between concave grooves in the cutting edge. That is, a concave groove having offsets may be adjacent to and located between a pair of concave grooves without offsets 530.

As discussed above, offsetting the teeth may form a sharp point with a complex cutting edge that runs approximately vertical and by design will have the ability to cut (tear) food equally well when the knife is stroked forward or backward. Although such an offset would be difficult if not extremely expensive to accomplish in steel, as it would require tiny cutting tools on a CNC machine and would take a long time to do on an expensive piece of machinery, creating such an offset can be easily and cost effectively molded in plastic. Additionally, the cutting teeth may have negative rake which is good for use in plastic because plastic knives cannot really cut like a steel knife (due to lack of hardness) they can only tear through the food.

Figure 7:
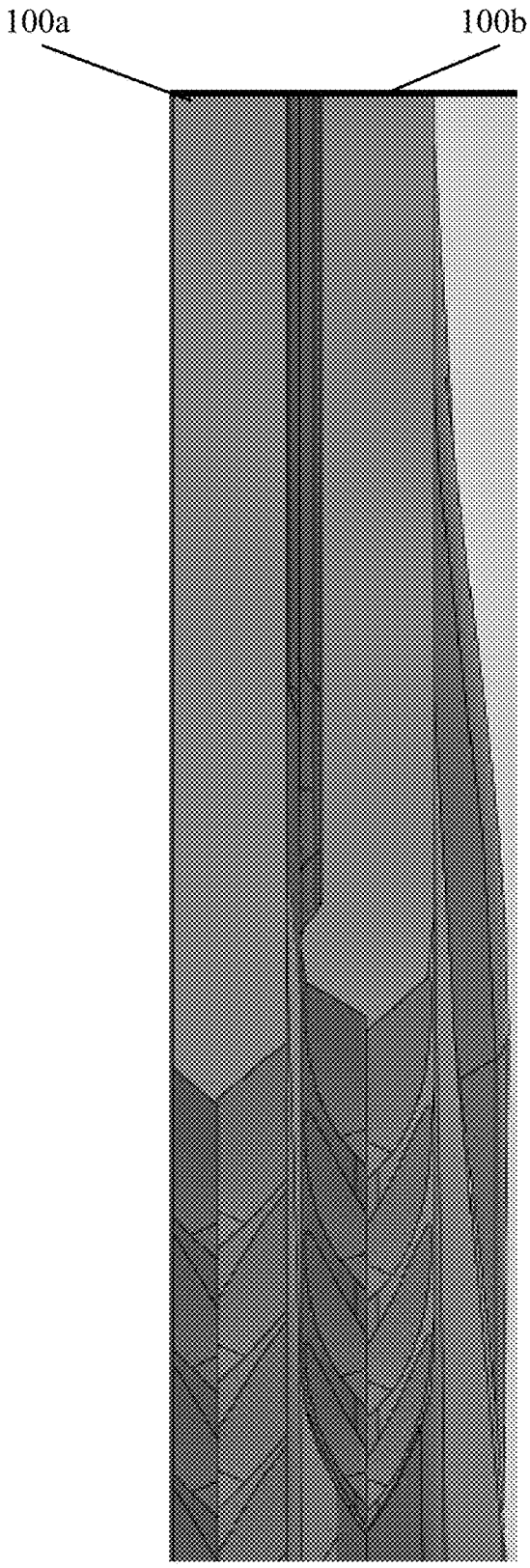
FIG. 7 illustrates a cross-section view of stacked knives, according to one example.

FIG. 7 illustrates a cross-section view of stacked knives, according to one example.

One or more of the components and functions illustrated in the previous figures may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications are possible. Those skilled, in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. A plastic knife, comprising:

a handle;

a blade including a first surface and an opposite second surface, and integrally formed with and extending longitudinally from the handle; and a cutting edge along a single edge of the blade, the cutting edge comprising:

a first plurality of teeth integrally connected to and extending from the first surface, each tooth in the first plurality of teeth separated by a first concave groove; and a second plurality of teeth integrally connected to and extending from the second surface, each tooth in the second plurality of teeth separated by a second concave groove;

wherein the first plurality of teeth and the second plurality of teeth are monolithic and both the first plurality of teeth and second plurality of teeth extend to and define the cutting edge; and wherein teeth in the first plurality of teeth and teeth in the second plurality of teeth are longitudinally offset by a distance along the single edge of the blade.

2. The plastic knife of claim 1, wherein the distance along the single edge of the blade is 0.25 mm or less.

3. The plastic knife of claim 1, wherein the teeth in the first plurality of teeth are a mirror image of the teeth in the second plurality of teeth.

4. The plastic knife of claim 1, wherein offsetting the teeth in the first plurality of teeth and the teeth in the second plurality of teeth facilitates cutting an object when the knife is stroked forward or backward.

5. The plastic knife of claim 1, wherein each tooth in the first plurality of teeth is separated by a first side concave groove and each tooth in the second plurality of teeth is separated by a second side concave groove, and wherein each of the first side concave groove and the second side concave groove are on the cutting edge formed along the single edge of the blade.

6. The plastic knife of claim 5, wherein each tooth in the first plurality of teeth comprises:

a first side having a first side upper end connected to a first concave groove;

a second side having a second side upper end connected to a second concave groove; and a cutting edge portion connected between the first side upper end and the second side upper end.

7. The plastic knife of claim 6, wherein the first and second sides have an arcuate shape.

8. The plastic knife of claim 6, wherein the first concave groove is adjacent to the second concave groove.

9. The plastic knife of claim 8, wherein the first side is a mirror image of the second side.

10. The plastic knife of claim 1, wherein the teeth in the first plurality of teeth are a same width as the teeth in the second plurality of teeth.

11. The plastic knife of claim 1, wherein the teeth in the first plurality of teeth have a first width and the teeth in the second plurality of teeth have a second width; and wherein the first width is different than the second width.

12. The plastic knife of claim 11, wherein the teeth in the first plurality of teeth and the teeth in the second plurality of teeth create a pair of offsets located within a shared concave groove, the shared concave groove includes a first tooth segment on a first side of the concave groove and a second tooth segment on a second side of the concave groove, the first tooth side associated with a first composite knife tooth and the second tooth side associated with a second composite knife tooth different than the first composite knife tooth.

13. The plastic knife of claim 12, wherein adjacent shared concave grooves in the cutting edge include the pair of offsets.

14. A disposable knife, comprising:

a handle;

a blade including a first surface and an opposite second surface, the blade extending longitudinally from the handle; and a cutting edge along a single edge of the blade, the cutting edge comprising:

a first plurality of teeth extending from the first surface, each tooth in the first plurality of teeth separated by a first concave groove; and a second plurality of teeth extending from the second surface, each tooth in the second plurality of teeth separated by a second concave groove;

wherein the first plurality of teeth and the second plurality of teeth are integral and both the first plurality of teeth and second plurality of teeth extend to and define the cutting edge; and wherein teeth in the first plurality of teeth and teeth in the second plurality of teeth are longitudinally offset by a distance along the single edge of the blade.

15. A knife, comprising:

a blade including a first surface and an opposite second surface, the blade extending longitudinally from the handle; and a cutting edge along a single edge of the blade, the cutting edge comprising:

a first plurality of teeth extending from the first surface, each tooth in the first plurality of teeth separated by a first concave groove; and a second plurality of teeth extending from the second surface, each tooth in the second plurality of teeth separated by a second concave groove;

wherein the first plurality of teeth and the second plurality of teeth are integral and both the first plurality of teeth and second plurality of teeth extend to and define the cutting edge; and wherein teeth in the first plurality of teeth and teeth in the second plurality of teeth are longitudinally offset by a distance along the single edge of the blade.

* * * * *